US007382267B2

(12) United States Patent
Brendley et al.

(10) Patent No.: US 7,382,267 B2
(45) Date of Patent: Jun. 3, 2008

(54) SYSTEMS AND METHODS FOR AREA ACTIVITY MONITORING AND PERSONNEL IDENTIFICATION

(75) Inventors: Keith W. Brendley, McLean, VA (US); Jed Marti, Salt Lake City, UT (US); William Virnig, Salt Lake City, UT (US)

(73) Assignee: Artis LLC, Reston, VA (US)

( * ) Notice: Subject to any disclaimer, the term of this patent is extended or adjusted under 35 U.S.C. 154(b) by 285 days.

(21) Appl. No.: 11/045,579

(22) Filed: Jan. 31, 2005

(65) Prior Publication Data

US 2006/0171570 A1 Aug. 3, 2006

(51) Int. Cl.
*G08B 23/00* (2006.01)

(52) U.S. Cl. ..... 340/573.1; 340/541; 702/173

(58) Field of Classification Search ..... 340/573.1, 340/5.8, 541, 568.1, 665, 666; 361/189; 702/173

See application file for complete search history.

(56) References Cited

U.S. PATENT DOCUMENTS 4,888,581 A * 12/1989 Guscott ..... 340/666
6,515,586 B1 * 2/2003 Wymore ..... 340/541
6,707,386 B1 * 3/2004 Pruisner ..... 340/665
6,965,311 B1 * 11/2005 Karner ..... 340/539.12

* cited by examiner

*Primary Examiner*—Phung T. Nguyen
(74) *Attorney, Agent, or Firm*—Nixon & Vanderhye PC

(57) ABSTRACT

"Smartmat" (Smartmat Area Activity Monitor and Personnel Identification System) monitors and identifies people, animals and other objects that pass through a control volume. Among other attributes, the exemplary system implementation can count, classify and identify objects, such as pedestrians, animals, bicycles, wheelchairs, vehicles, rollerbladers and other objects, either singly or in groups. Exemplary Smartmat implementations differentiate objects based on weight, footprint and floor/wall pressure patterns such as footfall patterns of pedestrians and other patterns. The system may be applied to security monitoring, physical activity monitoring, market traffic surveys and other traffic surveys, security checkpoint/gate monitoring, traffic light activation and other device activation such as security cameras, and other monitoring applications. Smartmat may be portable or permanently installed.

16 Claims, 16 Drawing Sheets

**One example of a basic *Smartmat* system**

**Figure 1: One example of a basic *Smartmat* system**

**Figure 2: Expanded view of *Smartmat* layers**

**Figure 3A: Exemplary *Smartmat* Elements**

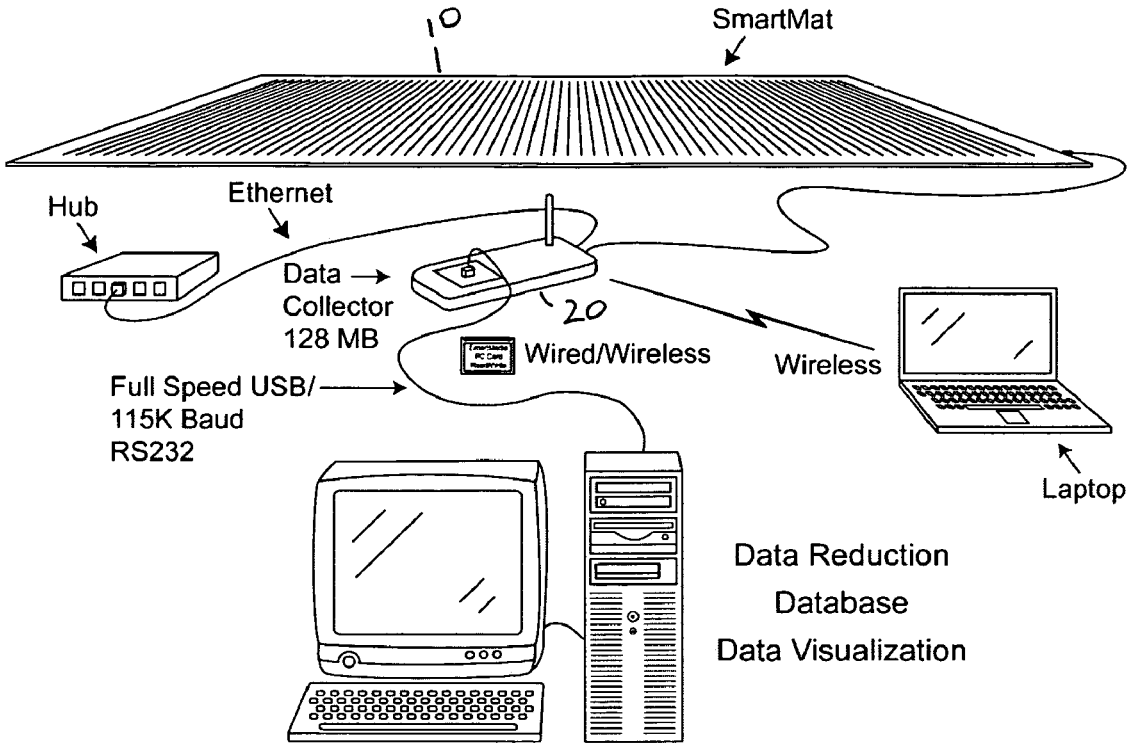
**Figure 4: General *Smartmat* Organization**

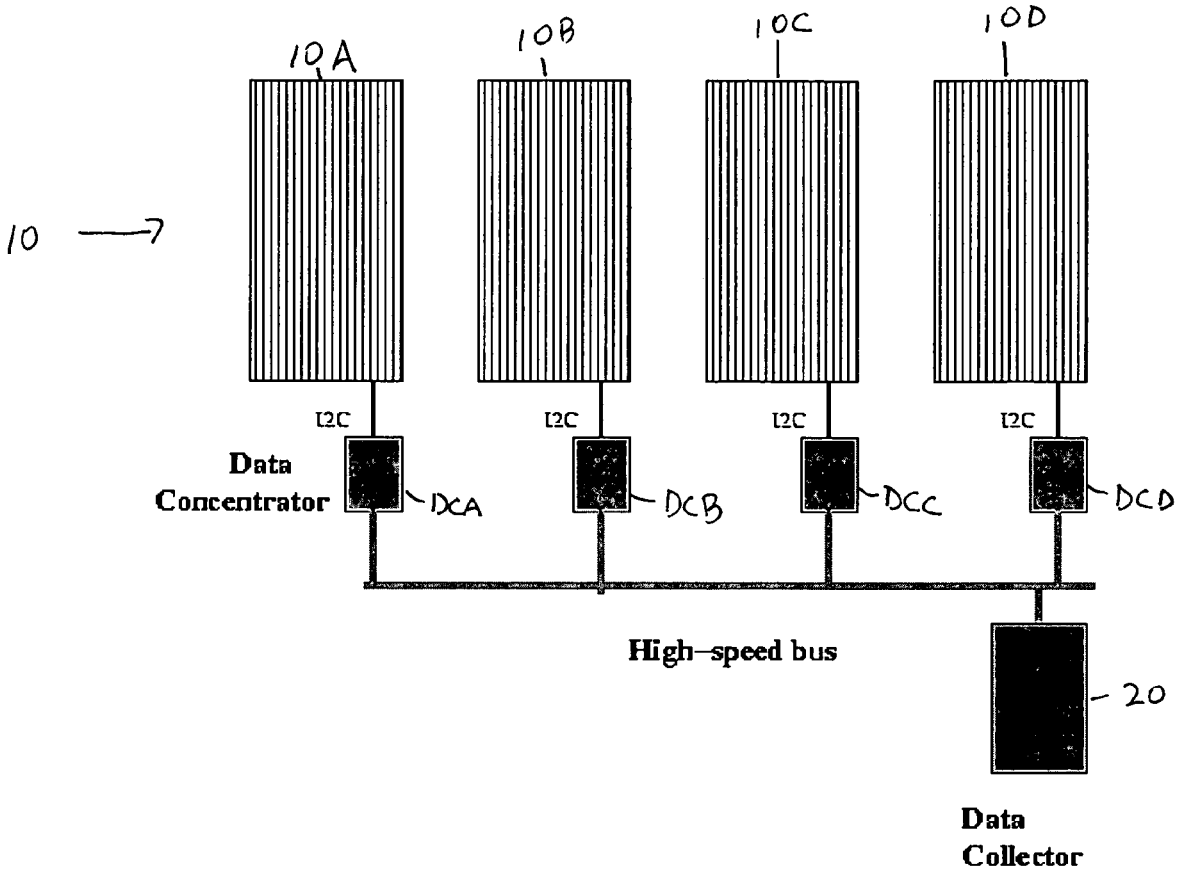
Figure 5: Network of multiple Smartmats.

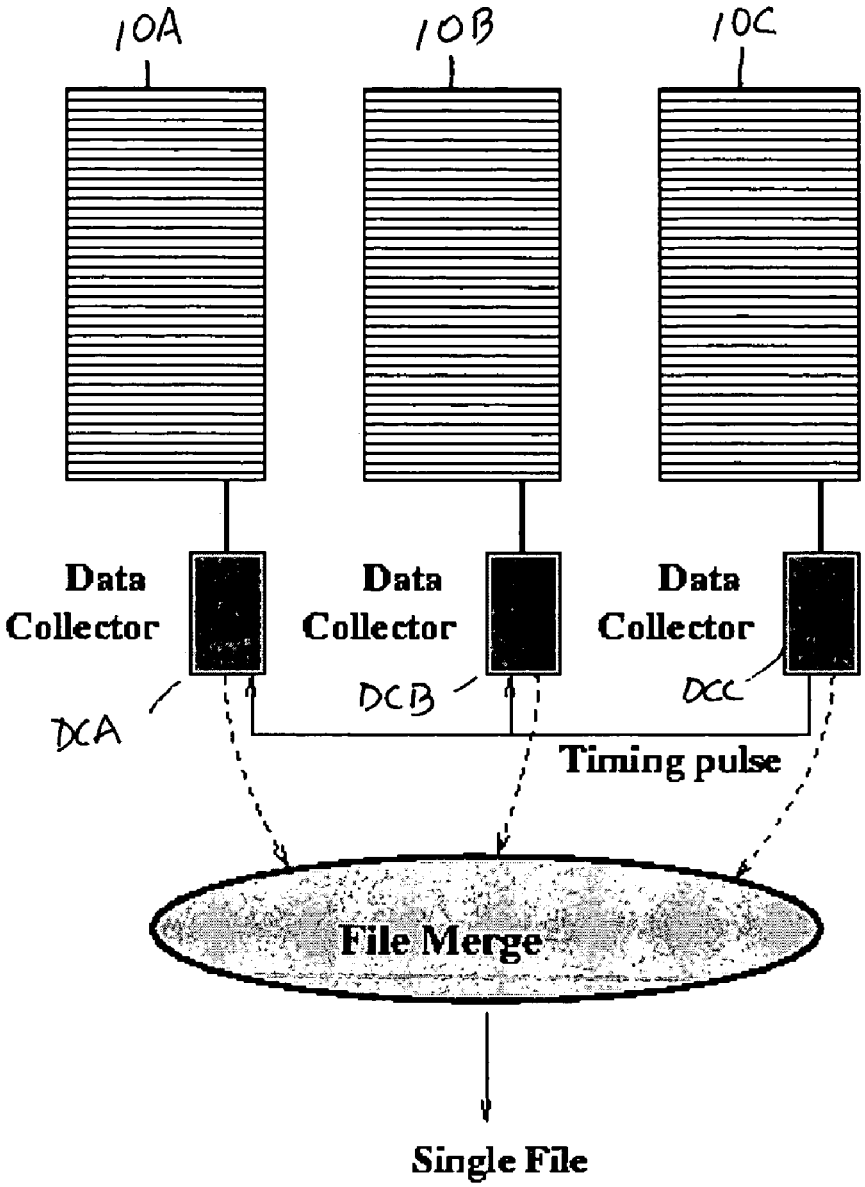
Figure 6: Multiple mats connected through software.

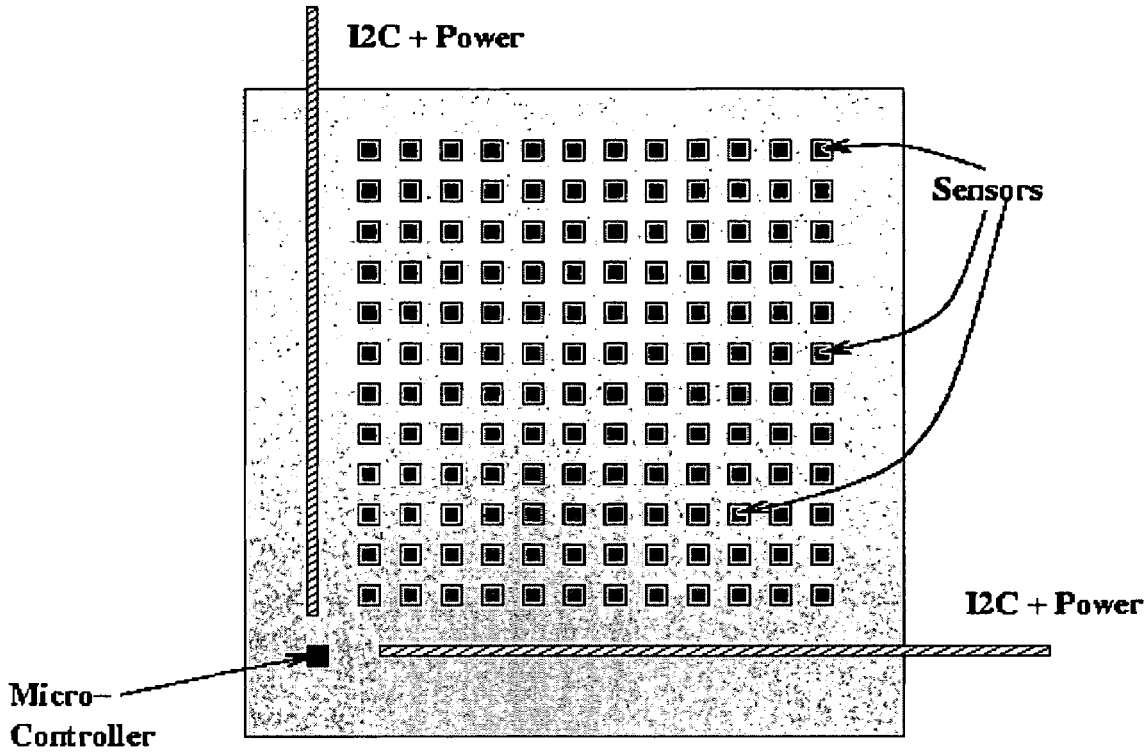
Figure 7: *Smartmat* Segment Organization
10

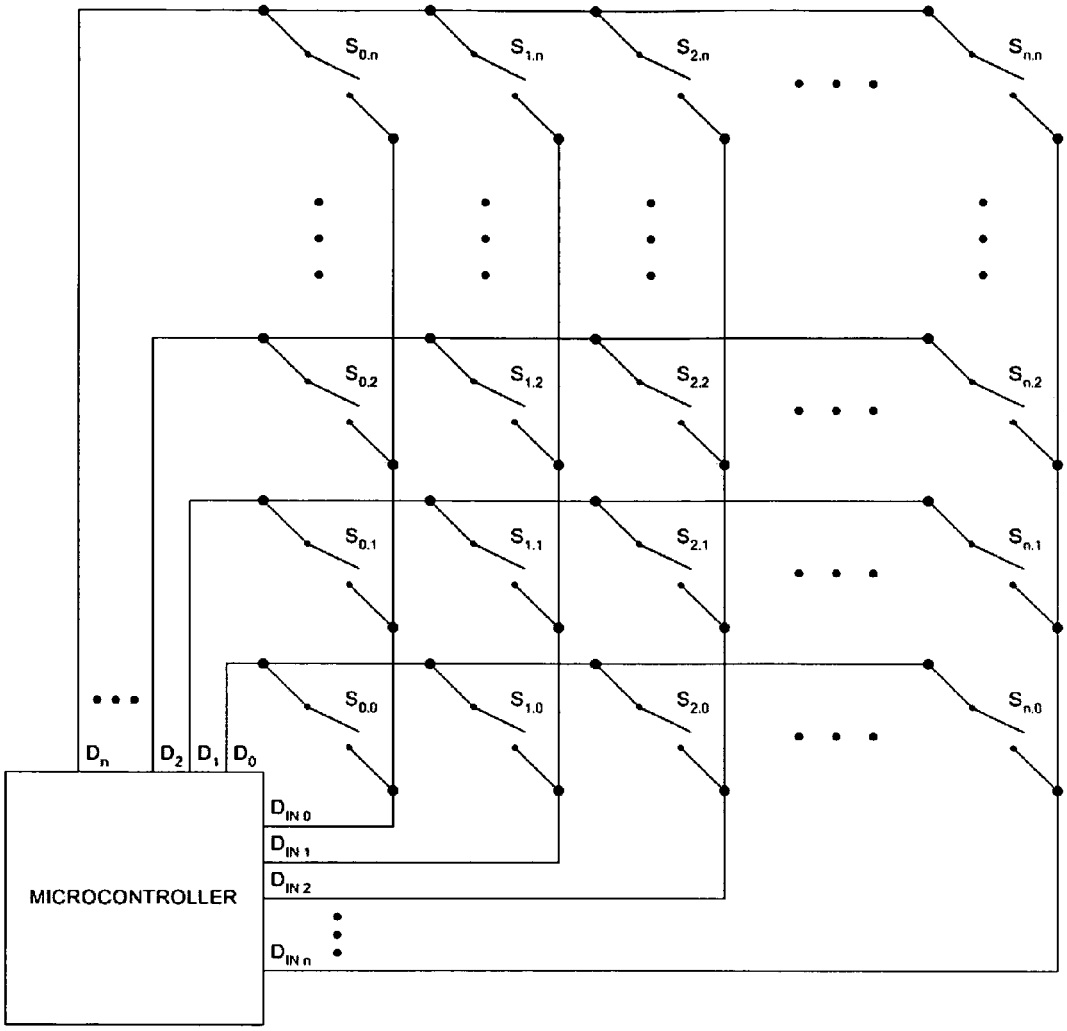
Figure 8: Segment Circuit Diagram for Switch based input.

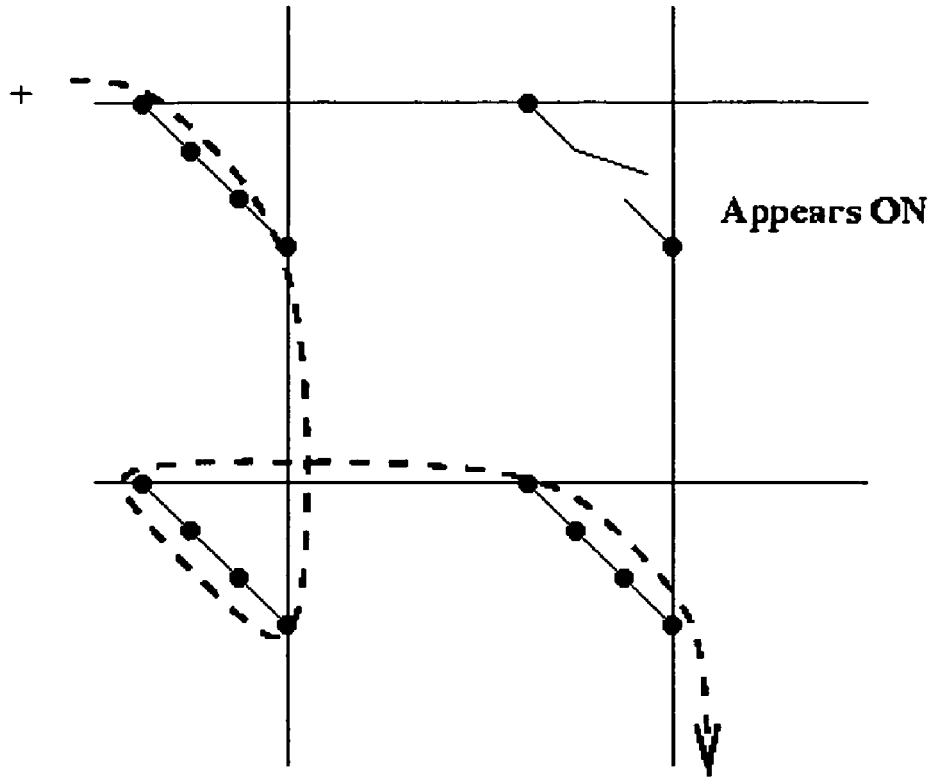
Figure 9: Ghosting current flow path.

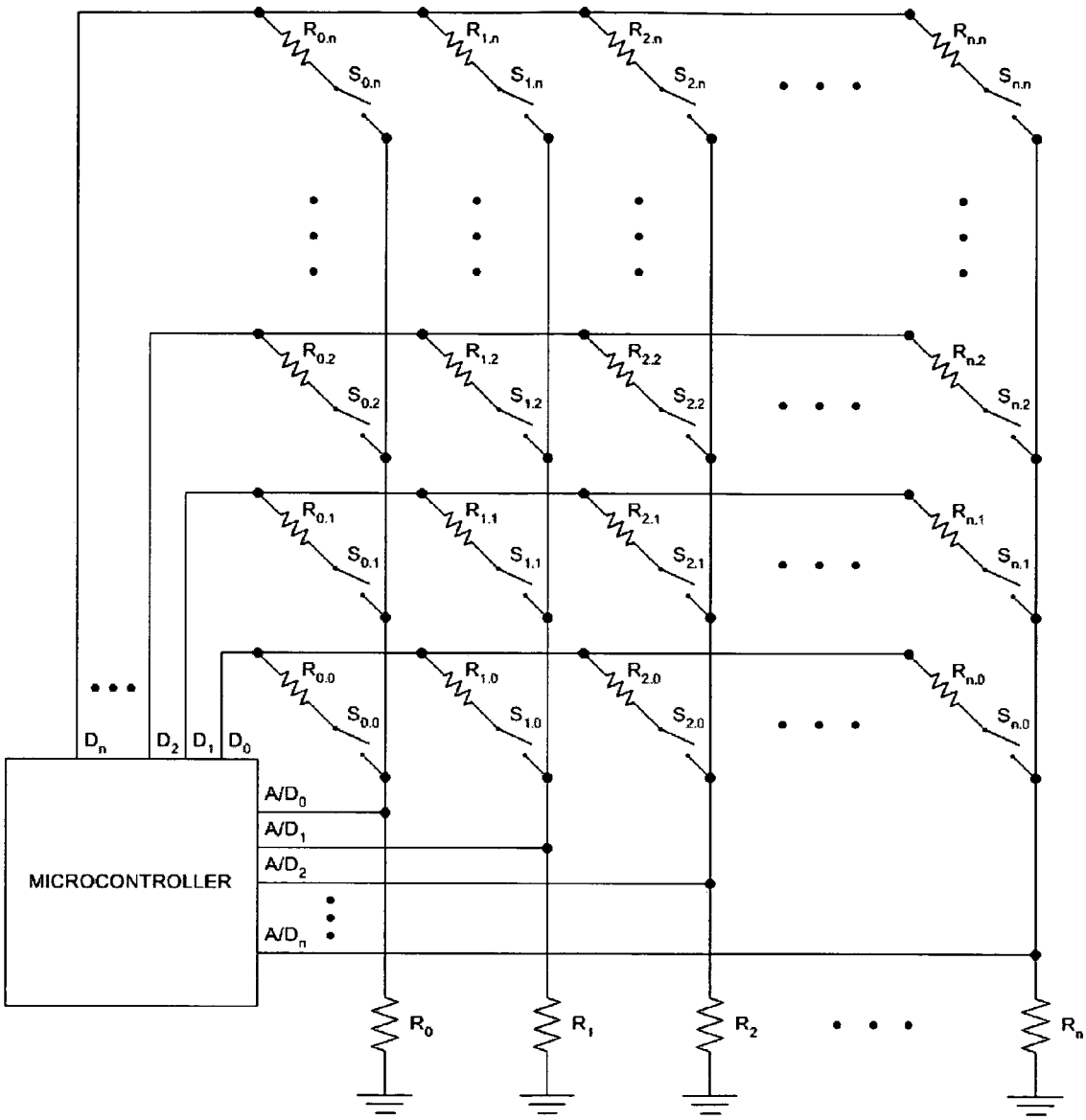
Figure 10: Switch de-ghosting example circuitry.

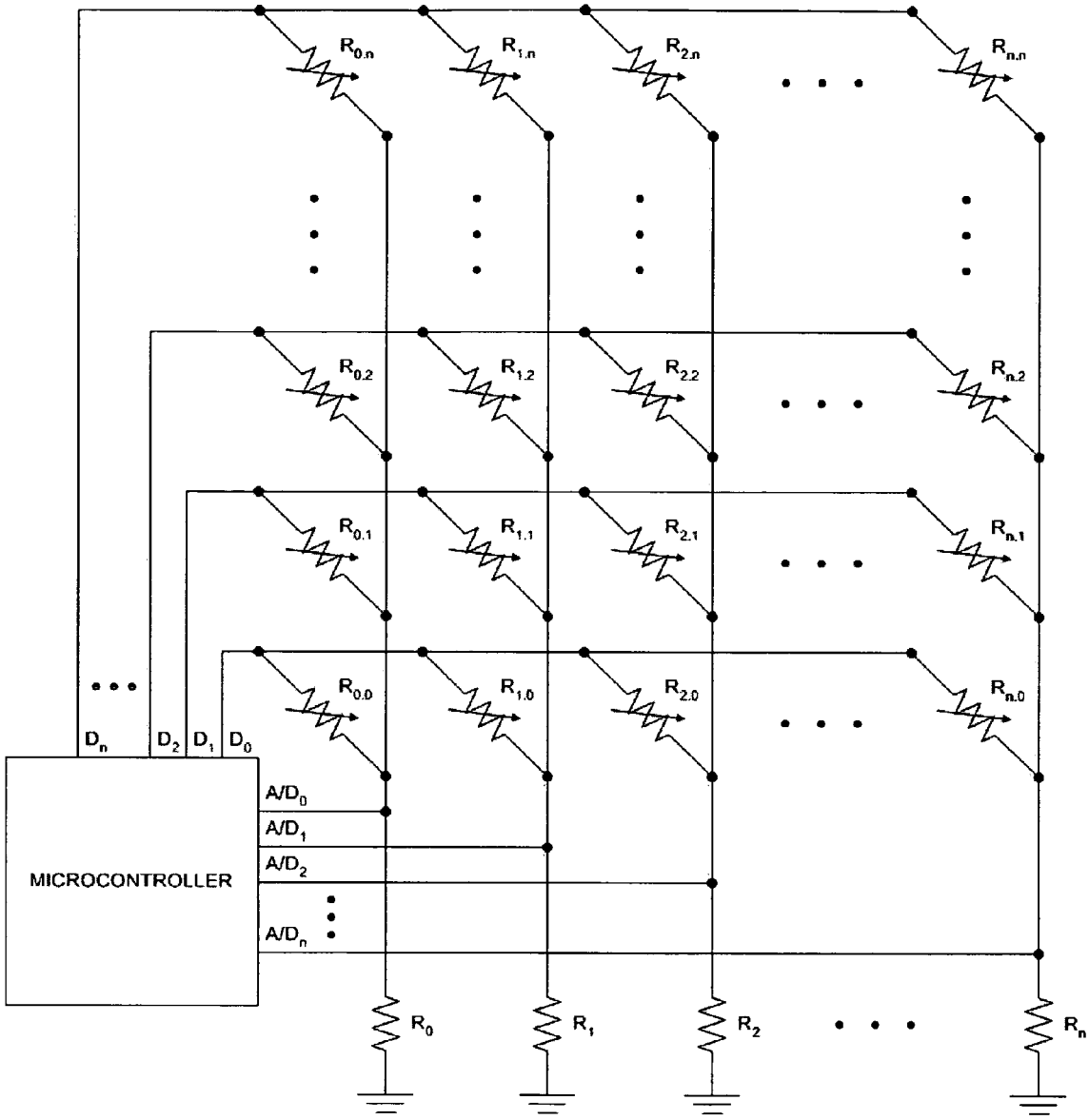
Figure 11: Analog segment circuitry.

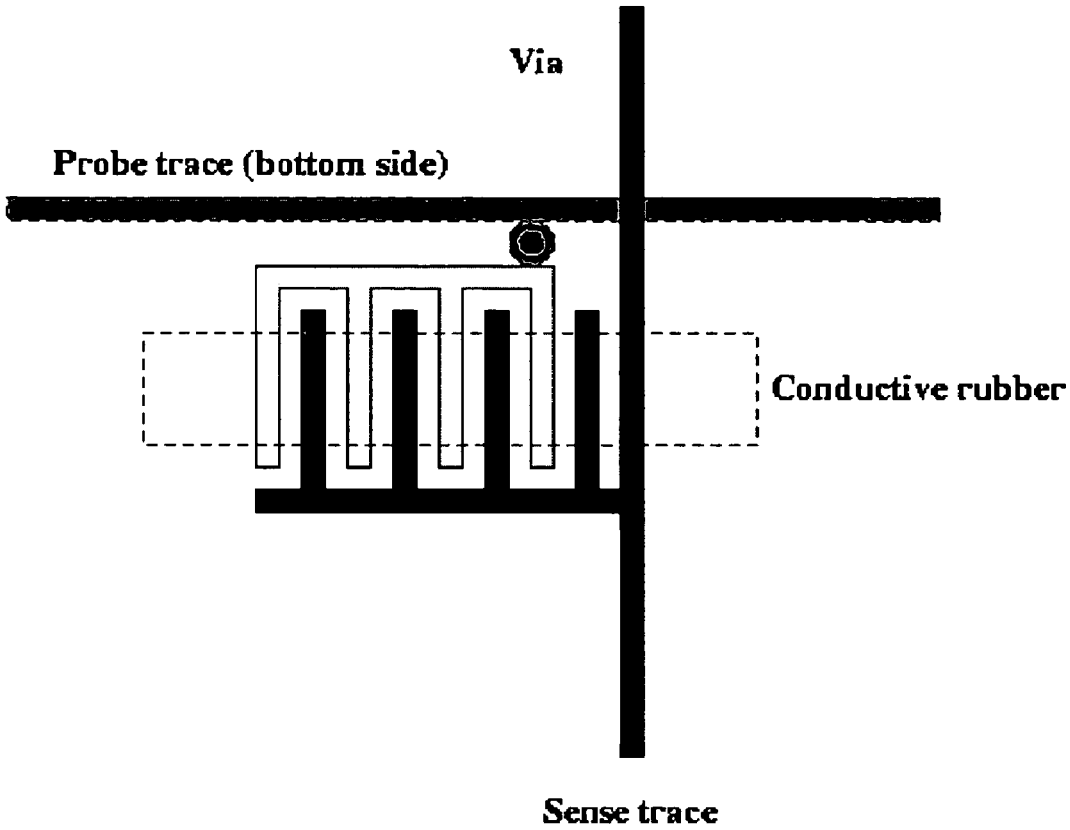
Figure 12: Conductive rubber switches
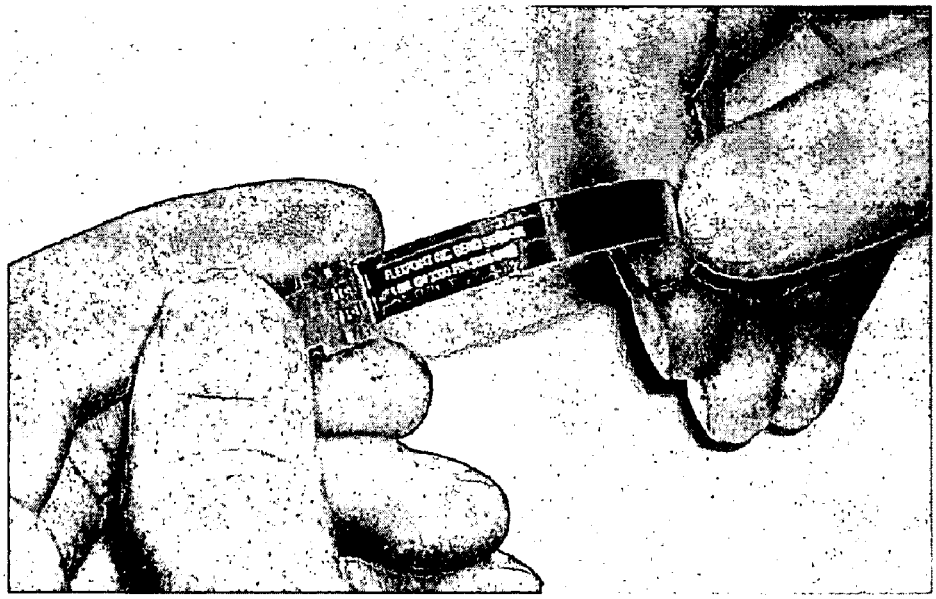
Figure 13: Single Flexpoint sensor.

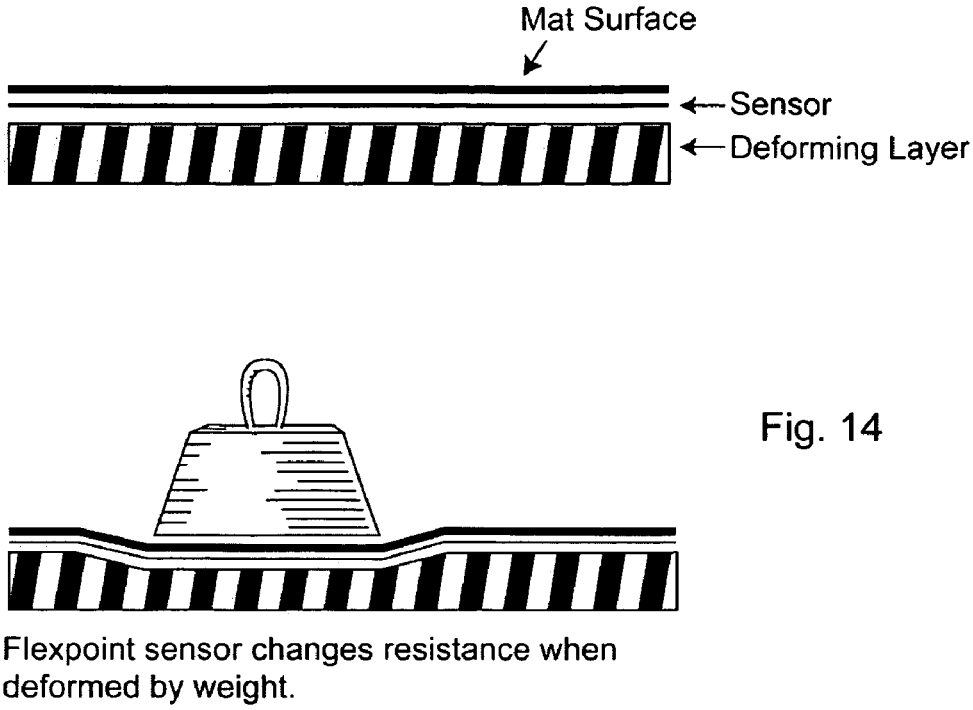
Figure 14: Analog sensor changes resistance when deformed by weight.

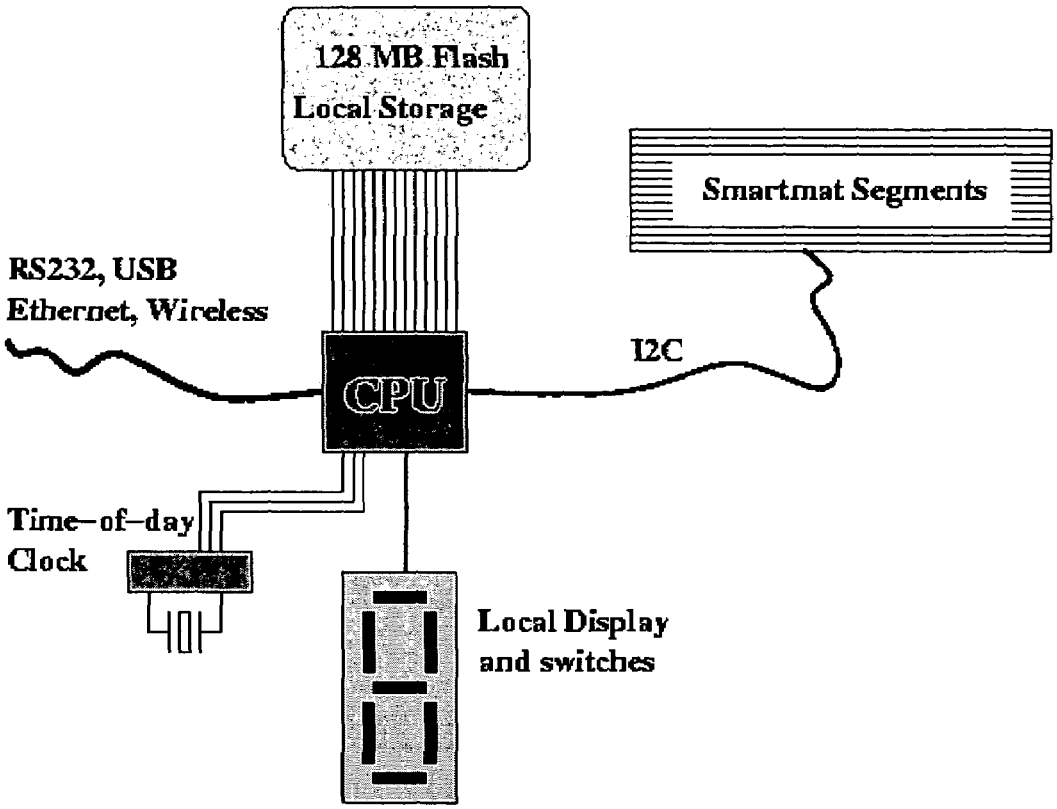
Figure 15: Data Collector Organization.

DATA CONCENTRATOR
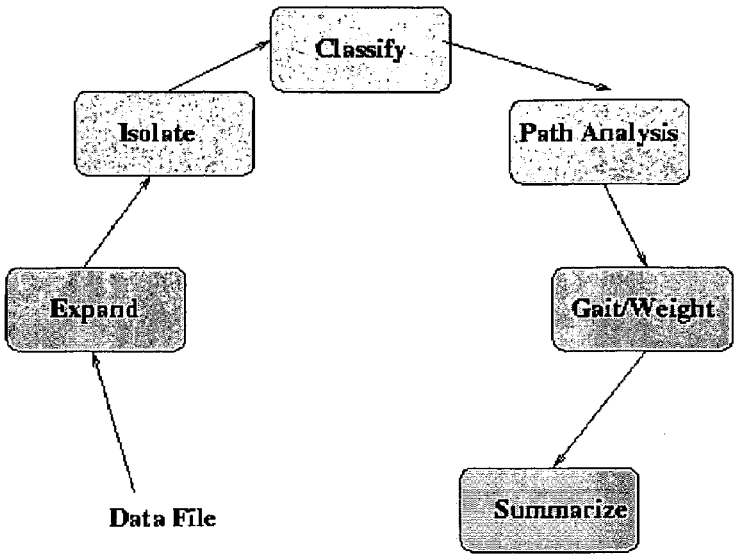
Figure 16: General Analysis Flow
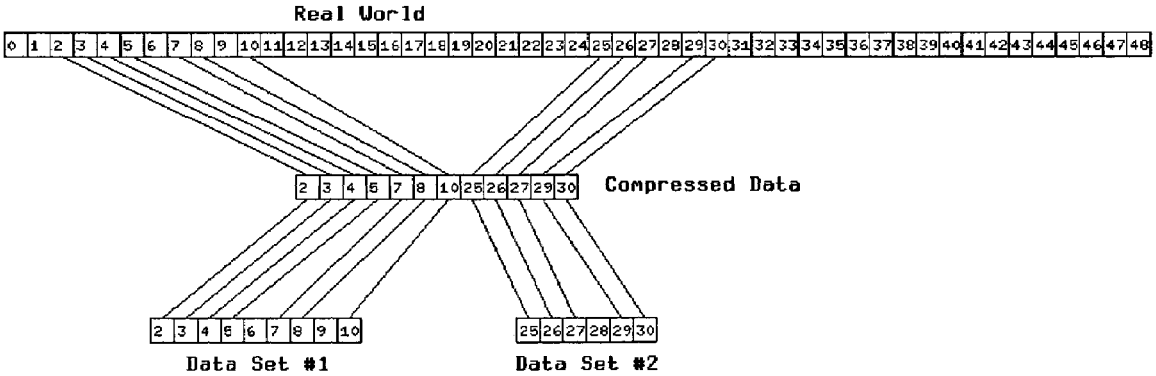
Figure 17: Expansion of Frames.

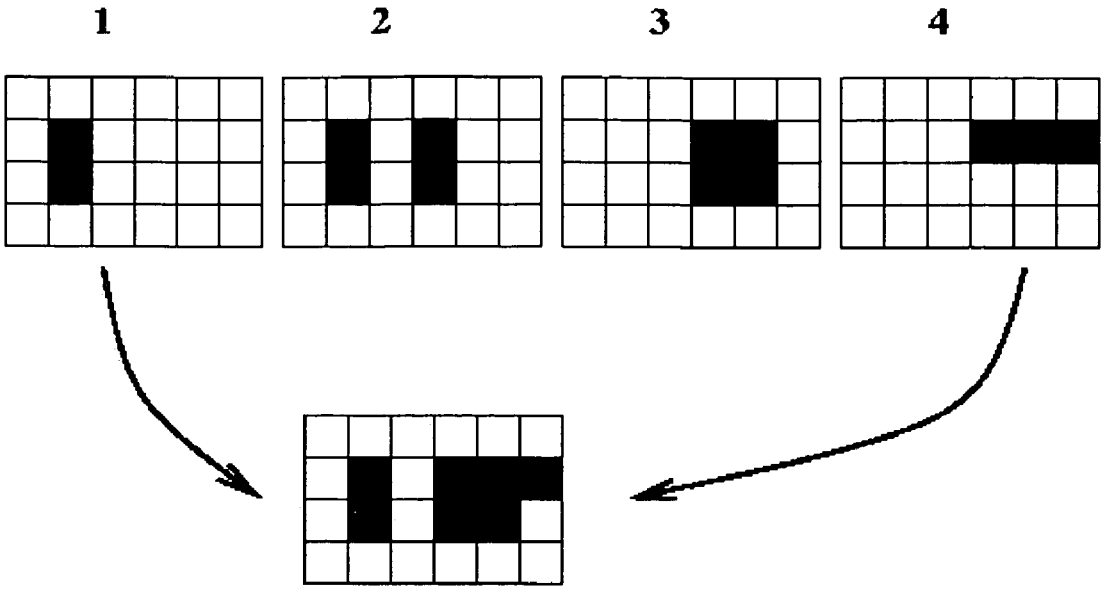
Figure 18: Polygon fill over time to develop a footprint.
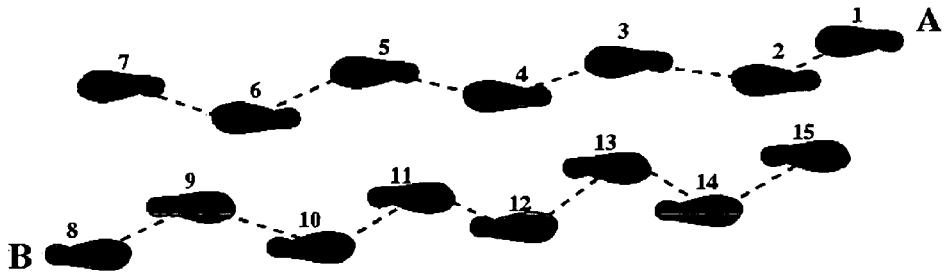
Figure 19: Assembling individual footfalls into paths.

SYSTEMS AND METHODS FOR AREA ACTIVITY MONITORING AND PERSONNEL IDENTIFICATION

STATEMENT REGARDING FEDERALLY SPONSORED RESEARCH OR DEVELOPMENT

This invention was made with Government support under Contract 200-2004-07959 awarded by the Centers for Disease Control and Prevention. The Government has certain rights in the invention.

CROSS-REFERENCES TO RELATED APPLICATIONS

Not Applicable.

FIELD

The technology herein relates to systems and methods for dynamically or otherwise classifying, counting, identifying and/or tracking persons or other animate entities based on tread and/or gait. In more detail, the technology herein relates to such systems and methods with application to security, health monitoring, market surveys and other areas.

BACKGROUND AND SUMMARY

I. Exemplary Security Applications

Much of security monitoring is concerned with visually monitoring areas looking for security issues or even specific security threats. Security cameras are common features in banks, shopping malls, parking lots, office buildings, schools, hospitals and retail outlets to name but a few. While security cameras yield good information on traffic patterns and visual activities, they present many challenges in both setup and use. For setup, they may be placed in an area that has a good field of view of the area being monitored. This normally entails placing them at some height above that of the average object of interest. They may be supplied with power and adequate lighting. They are attractive targets for both theft and vandalism, so they may need to be protected. To increase their field of view, some cameras may be steered and thus may be placed within a controllable housing which involves considerable additional complexity. For real-time monitoring, the camera video signal may need to be conveyed back to a control area. Since surreptitious monitoring is sometimes desirable, the cameras may need to be placed behind some sort of visually deceptive screen.

Proper upkeep and monitoring of security cameras typically requires many functions to be performed. The lens typically needs to be kept free of dirt and debris. Tapes need to be stored and changed, and endless loop tapes may need to be periodically checked for damage. If real-time monitoring is required, a dedicated staff may maintain constant vigilance over, sometimes, many displays as they cycle through an oftentimes even larger number of cameras. These cameras are often equipped with motion sensors or other cueing sensor; however, the false alarm rates for these systems can be high depending on the type of sensor, its placement and the environment.

With the perceived heightened security threats in many public places, there is a need for systems that can identify specific humans. Cameras are only very rarely equipped with autonomous evaluation software that would attempt to count people or otherwise evaluate broad traffic patterns. Some other types of video systems operate in either the visual, near infrared (NIR) or thermal bands of the electromagnetic spectrum. In general, these systems work by defining face characteristics and then matching these characteristics to a database. Such systems typically require careful setup to attain the proper lighting conditions, camera angle and throughput. Other technologies under consideration include Doppler and MTI radar for examining gait characteristics. Such systems require line-of-sight to the subject and are thus susceptible to problems with occlusion. They also often rely strictly on external geometry characteristics of the subject.

II. Exemplary Health Monitoring Applications

The sedentary nature of many adults along with commensurate levels of obesity is among the highest health risk factors facing Americans today. It is reported that only 40% of Americans are physically active, leaving the majority more susceptible to heart disease, diabetes, some cancers and other debilitating diseases (Harvard Center for Cancer Prevention, Harvard School of Public Health, Newsletter, February/March 2001).

While inadequate levels of exercise have a profound impact on the lives of many people, measuring this effect is difficult. Current approaches include self-report surveys, subject studies employing pedometers, heart rate monitors and accelerometer devices, the doubly-labeled water method, field observations and field sensors. For higher levels of habitual physical exercise, physical fitness markers such as blood pressure or stress test measurements have also been used. These methods are generally unreliable, expensive, or intrusive.

Regarding field sensors, typical devices for measuring physical activity include: video, infra-red (optical) beam and acoustic. These systems are designed to count individuals crossing a line while walking.

Video systems are generally considered the current gold standard in this area. Video output is streamed to a computer where software image processing reduces the data to provide head counts. Problems with video systems include expense, long set-up times, and risk of vandalism or theft. In addition, the video processing software is often inconvenient to use and suffers accuracy problems with crowds.

The infra-red and acoustic systems are less expensive, but they are also much less accurate, especially when used with crowds. They are difficult to set up and calibrate, and it is very difficult to check the data for accuracy. With a video system, if the researcher is doubtful regarding a particular span of time, they may go back and review the video to determine the accuracy of the count. With an IR or acoustic system, such checks are generally not practical.

III. Market Survey Systems

Modern retail outlet design generally requires accurate knowledge of consumer traffic patterns. High value goods are place in areas that increase their prominence and sales opportunities. An example of this is the placement of the meat and deli counters at the end of the aisles in most grocery stores. As shoppers move up and down the aisles they are given repeated opportunities to view the meat and deli counters, thus increasing the probability that they will either remember some item that they may need or even be enticed by the display to purchase these high margin products. In addition, traffic flow is important for generating a pleasing shopping experience. The competition for shelf space in some high-volume outlets is keen, and a knowledge of shopper traffic patterns permits good design of permanent shelving and temporary displays that maximize shelf space while minimizing congestion at peak traffic flow rates.

Current tools for monitoring patterns are based primarily on human observers either on site or remote via television camera. Surveys are laborious and time-consuming activities. Thus, many organizations restrict their surveys to selected test stores and assume that the results carry across all stores. This is one reason why many retail outlets appear similar in layout. (Another important reason is consistency in shopping experience across a branded chain.)

Thus, while much work has been done in the past, further developments are both necessary and desirable.

The exemplary illustrative non-limiting technology herein provides, in one illustrative non-limiting exemplary implementation referred to herein as "Smartmat" (Smartmat Area Activity Monitor and Personnel Identification System), monitoring and identifying people, animals and other objects that pass through a control volume. Among other attributes, the exemplary system implementation can count, classify and identify objects, such as pedestrians, animals, bicycles, wheelchairs, vehicles, rollerbladers and other objects, either singlely or in groups. Exemplary Smartmat implementations differentiate objects based on weight, footprint and floor/wall pressure patterns such as footfall patterns of pedestrians and other patterns. The system may be applied to security monitoring, physical activity monitoring, market traffic surveys and other traffic surveys, security checkpoint/gate monitoring, traffic light activation and other device activation such as security cameras, and other monitoring applications. Smartmat may be portable or permanently installed. In one instantiation of the technology, it is affordable, rugged, quickly set up, easy to use, works both in and outdoors, and operates for long periods of time. Smartmats can be of nearly any size and shape limited only by storage requirements and internal network bandwidth. A Smartmat's geometry is stored with the mat—non-rectangular shapes can be created and more than one mat can be connected in a network. Smartmats can communicate with each other to synchronize their time stamps and control power consumption. A collection of Smartmats in a building can be synchronized for high level analyses of traffic patterns or security mechanisms can be alerted. Other instantiations are possible. Data may be accessed via download using standard Smart Media cards, connect to the system via a serial port, Ethernet or wirelessly, either in batch or in real time or downloaded and monitored via other means. The Smartmat system often includes data management and data analysis software. System options may include an embedded GPS for recording outdoor placement and a Geographic Information System (GIS) for analyzing geospatial aspects of physical activity.

An example illustrative non-limiting instantiation may possess the following attributes:

- reasonable cost (e.g., less than $100 per sq. ft.)
- set up by minimally trained personnel quickly (e.g., in less than 10 minutes)
- durable in all weather
- vandalism resistant (puncture resistant, redundant signal paths)
- theft resistant (little apparent value, hard points for securing)
- easy to download data
- collect data for a reasonable length of time (e.g., 72 hours minimum, up to 2 weeks in low-traffic areas)
- minimal data loss risk (storage on permanent media)
- cover many different sized areas and slopes, to include stairs
- operate on unpaved surfaces free of excessive vegetation (maintained trails, fire-roads, other unimproved roads)
- accept and store metadata from a user interface (palmtop or laptop)
- properly mark data files with metadata (time, place, Smartmat ID, etc.)

Exemplary data reduction software may:

- count number of pedestrians with false alarm rate under 5%
- separate pedestrians from "noise" such as animals and bikers
- work with groups of pedestrians
- yield direction of pedestrians (especially important for stairways) to ±30 deg.
- time stamp all events local and Greenwich Mean Time (GMT)
- display raw data as "footprints" over time, with a counter that shows how the software is interpreting the footprints.

It is desirable, but not necessary, for exemplary non-limiting device implementations to be:

- programmable in the field (duty cycle, sensitivity, etc.)
- self-locating (GPS capable), GPS may be located in the user interface (palmtop), with data download at time of initiation cycle It is desirable, but not necessary, for exemplary non-limiting data reduction software implementations to:

- classify pedestrians based on stride length, footfall size and footfall pressure
- estimate pedestrian weight
- estimate speed of pedestrian
- yield data for bikes, roller blades, etc.
- store data in database with appropriate schema and all relevant metadata
- register data in a Geographic Information System (GIS) to permit geospatially-relevant analyses display data in a virtual environment that would show a scene of avatars walking through the controlled space
- other features and advantages.

BRIEF DESCRIPTION OF THE DRAWINGS

These and other features and advantages will be better and more completely understood by referring to the following detailed description of exemplary non-limiting illustrative embodiments in conjunction with the drawings of which:

FIGS. 3 and 3A show exemplary Smartmat Elements;

FIG. 4 is an exemplary, non-limiting illustration of Smartmat hardware organization;

FIG. 5 is an example of a Smartmat network based on hardware connections;

FIG. 6 is an example of a Smartmat network provided by a software interface;

FIG. 7 shows an exemplary organization of Smartmat segments;

FIG. 8 is an exemplary circuit diagram for an exemplary digital sensing version of Smartmat;

FIG. 9 illustrates potential exemplary sensor ghosting of the current flow path;

FIG. 10 is an exemplary circuit diagram of an exemplary switch network designed to mitigate sensor ghosting;

FIG. 11 is an exemplary circuit diagram of an exemplary analog sensing mechanism;

FIG. 12 is an exemplary diagram of an exemplary conductive rubber switch;

FIG. 13 is a photograph of one possible, non-limiting Smartmat analog sensor;

FIG. 14 is an exemplary diagram of how a flexible sensor may be configured to change resistance when weight is applied;

FIG. 15 is an exemplary diagram of how the data collector may be organized;

FIG. 16 is an exemplary diagram of software analysis organization;

FIG. 17 is an exemplary diagram of how frames using a specific, non-limiting example of data compression may be expended;

FIG. 18 is an exemplary diagram of one approach for using time-sensor analysis to form a footfall image; and FIG. 19 is an exemplary diagram of footfalls organized into a path.

DETAILED DESCRIPTION

An exemplary illustrative non-limiting Smartmat Area Monitoring and Analysis System is a tool for monitoring activity levels in a defined area and identifying objects within that area among other uses. Exemplary illustrative non-limiting implementations of the system may resemble an industrial carpet in appearance or take on other appearances performs many functions. For example, it may count pedestrians and other objects passing across it, note their direction, time and speed, compute their stride length and estimate their weight.

In another exemplary non-limiting instantiation, Smartmat may be used to identify specific people by comparing their foot imprints, gait characteristics, and footfall pressure characteristics among other possible characteristics. The exemplary system can work both with single users and with groups of people, and may differentiate between walkers, cyclists, animals and other objects. Smartmat may be designed to be portable, affordable, rugged, quickly set up, easy to use, work in or outdoors, and operate for long periods of time among other possible instantiations. Researchers and other users may download data or monitor data in real time. Examples of interactions include using standard SmartMedia cards, Secure Digital or XD or connecting to the system via a Universal Serial Bus (USB) port, Ethernet or wirelessly. The Smartmat system may include data management and data analysis software. System options may include an embedded GPS for recording outdoor placement and a Geographic Information System (GIS) for analyzing geospatial aspects of physical activity.

Exemplary applications for Smartmat include the worldwide research community interested in the pressing issue of population activity levels. It also includes government organizations interested in monitoring the success of various intervention strategies, managers of large public institutions interested in detailed traffic flow patterns, security professionals concerned with properly allocating assets based on pedestrian activities or identifying specific individuals, and marketing professionals interested in retail-level pedestrian traffic patterns.

Smartmat may be used for measuring relative activity levels in neighborhoods, schools, office complexes and recreational areas such as hiking and biking trails. Different implementations are desirable and possible. Not all researchers and other potential customers are interested in all of the capabilities that we can build into Smartmat and supporting software. For these customers, a simpler system is of greater interest. Second, some desirable goals, such as self-location via GPS, will add to system cost. In terms of exemplary implementation definition, we anticipate marketing a base model Smartmat and more capable models. Likewise, we will provide a highly flexible suite of data analysis software, some required for extracting data and other systems, such as a GIS, that are desirable only to a market segment.

Figure 1:
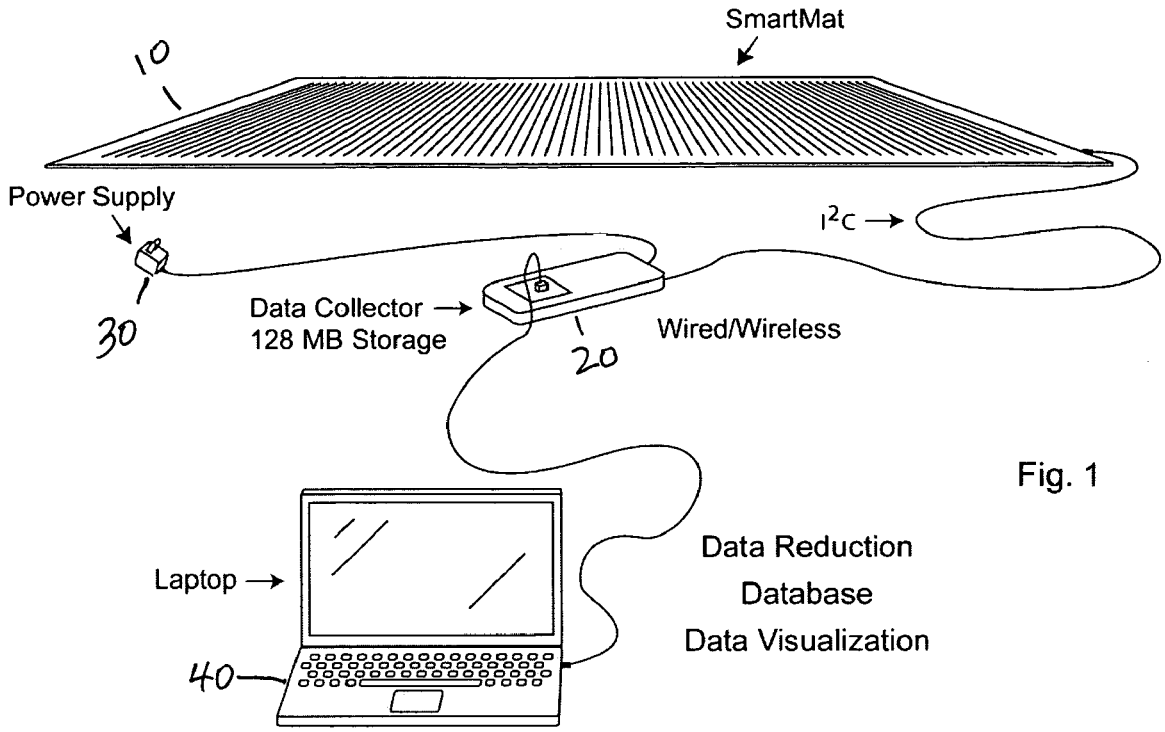
FIG. 1 is one example of an exemplary illustrative non-limiting Smartmat system.

One potential exemplary illustrative non-limiting configuration of an overall Smartmat system is shown in FIG. 1. System components may include:

Smartmat sensor surface 10

Data collector 20

Power source 30

Laptop computer or other data processor 40

One possible embodiment of Smartmat 10 collects data via embedded sensors and processing electronics. It writes data to a portable storage device, Ethernet connection or other communications mechanism. Smartmat may be field-programmable through a wireless or wired connection. Command settings may include Smartmat attributes such as sensor sampling frequency, sensitivity thresholds, and sampling times (e.g. if one wanted to sample the population only during "commuting" times). Smartmat may come with default settings for some or all values that should suffice in most cases without in-field interaction. A database may be provided for storing the data with appropriate metadata such as sampling time span, Smartmat location and orientation, experiment ID, Smartmat ID, deployment team ID and so forth. A data reduction capability may be provided for reducing raw sensor readings into statistics such as number of pedestrians, distribution of speed, distribution of direction, distribution of stride length, distribution of footfall size, type of activity (walking, running, etc.) and identification when compared with a database of known persons. Tools may be provided to view these data graphically both in terms of graphs, "footprint movies" and other views.

Figure 2:
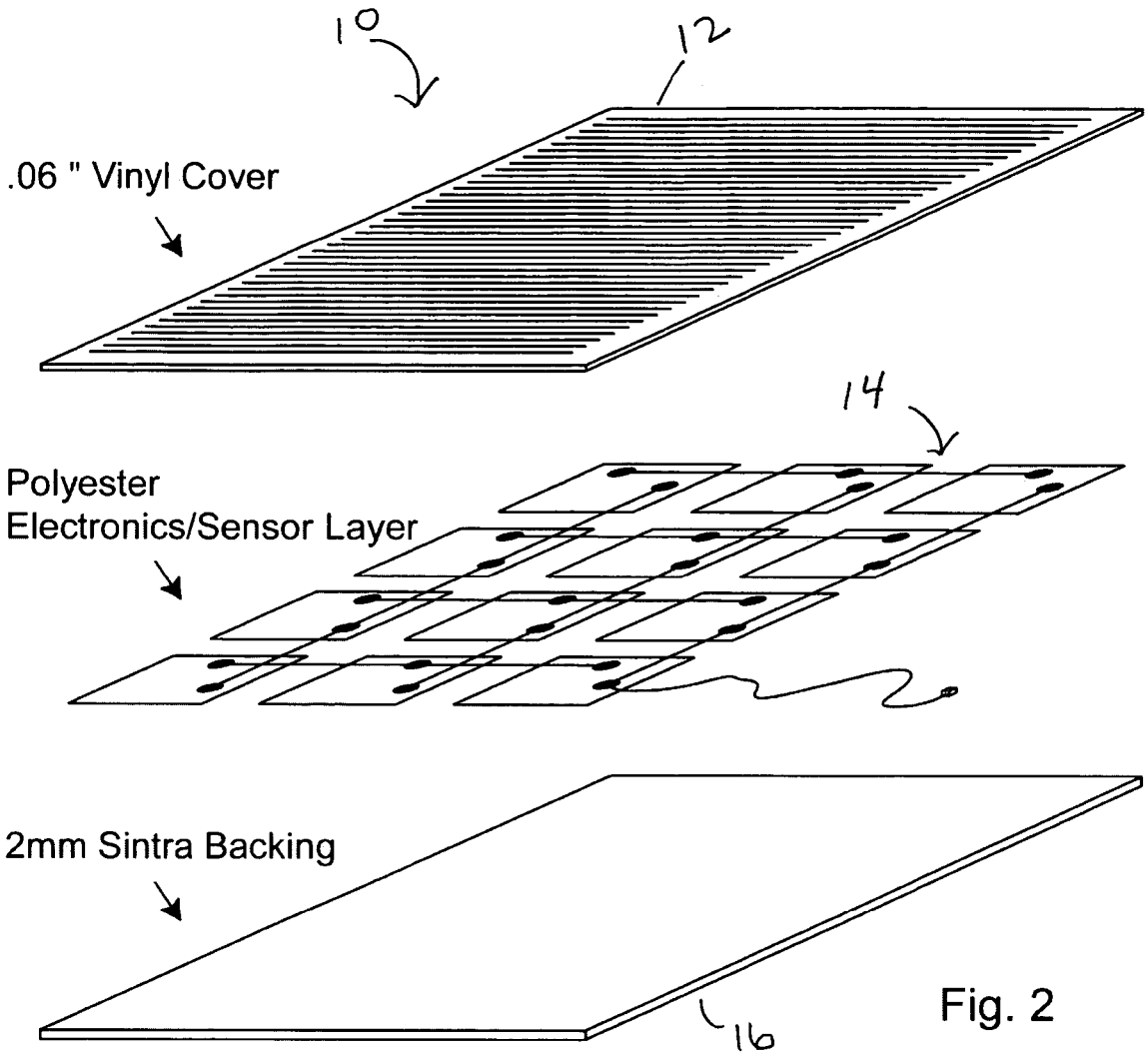
FIG. 2 is an expanded view of exemplary Smartmat layers.

An exemplary Smartmat comprised of 3 or more layers of material is shown in FIG. 2, although other configurations are possible: a top layer 12 of vinyl flooring, a second layer 14 of sensors and control electronics and a bottom layer 16. An intervening layer of a cushioning material such as neoprene is also common in some exemplary instantiations.

In this example, the topmost layer 12 will be a sheet of industrial vinyl flooring. This type of flooring is widely available and has excellent properties for use in even the harshest environments. It is skid resistant, puncture resistant, waterproof, oil and gas resistant, has good pliability over a very wide temperature range, comes in many colors, may be produced with almost any pattern of "ridges" on both surfaces, and is very low cost even when purchased in modest quantities. One may anticipate a ridged surface on the upward facing side (the one making contact with pedestrians), although other configurations are possible. A large body of experience in the industry indicates that this pattern is most effective outdoors across a wide variety of water and icing conditions. On the underside of the top layer, one may specify a "studded" pattern that matches the pattern of sensors, but this is not strictly necessary. In this manner, the effect that a footfall has on the layer of sensors may be physically controlled.

An example of the second layer 14 contains the electronic circuitry to connect the sensors and their processors into a network and to connect that network to the Data Collector. Possible sensor modalities include resistive bend sensors, conductive rubber, and electromechanical switches, but other sensors are possible.

An exemplary, optional third layer 16 provides a cushioning surface for resistive bend sensors so that foot pressure deforms the sensors and changes their resistance. This is typically a layer of 2-3 mm thick neoprene rubber or similar material.

An example of the bottom-most layer provides rigidity and protection for the electronics. A possible material for this would be a 2 mm to 3 mm thick layer of Sintra, which is machinable, bendable and durable.

Figure 3:
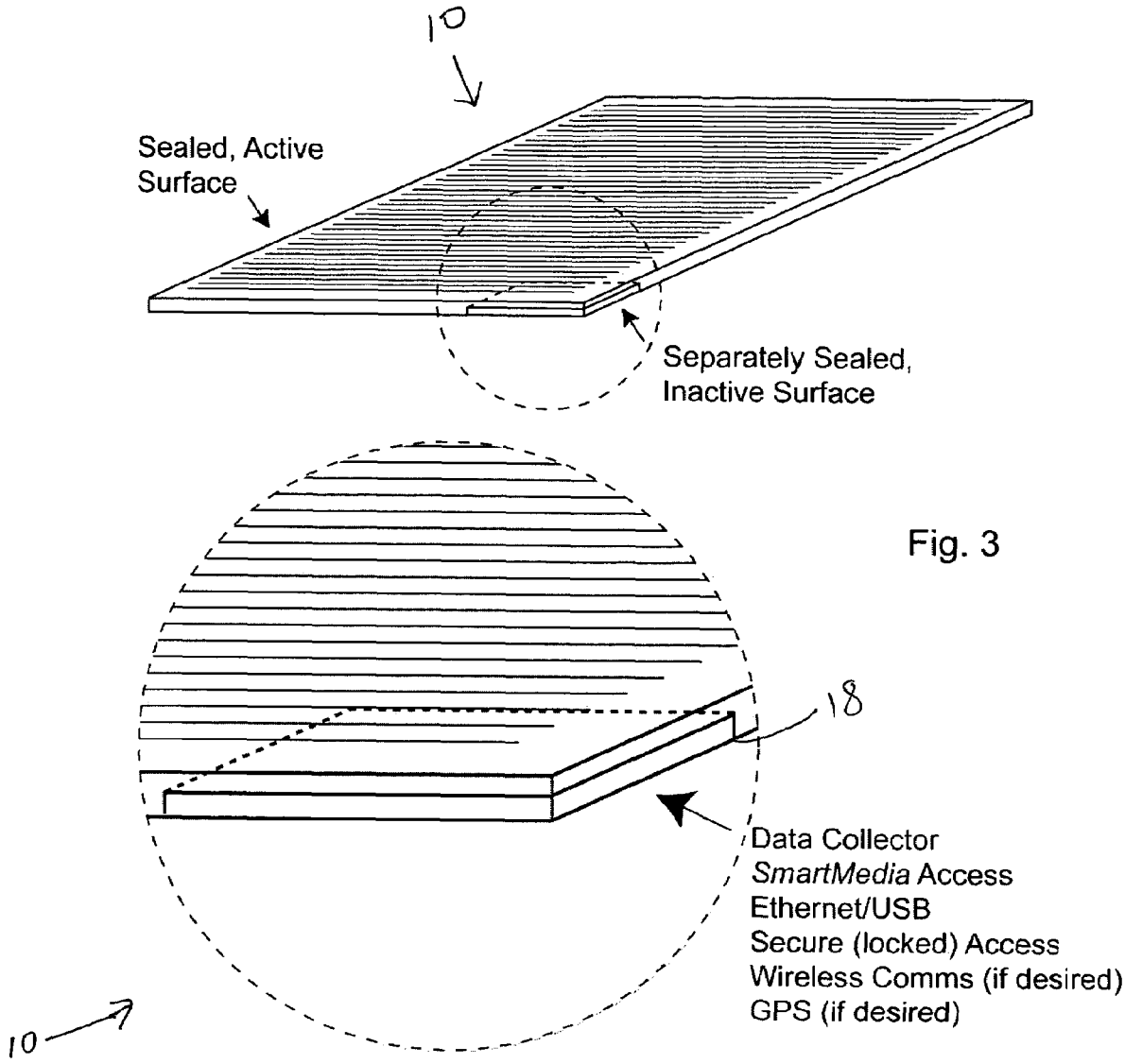

In the exemplary system, while the majority of electronic systems and all sensors will be encased in the vinyl "sandwich," one may also integrate a more standard electronics package into the Smartmat system. As shown in FIGS. 3 and 3A, an electronics "box" 18 may house components such as the data accumulator, SmartMedia interface, Ethernet port, a wireless communications system, GPS and other components. The electronics box itself will often be completely water-tight and locked. It may be manufactured of a high-impact resistant material such as nylon or other material. The box may be located on the underside of the mat, out of plain view or elsewhere. Researchers may in some cases access it through a miniature USB port after removing its protective covering.

General Organization on an Exemplary Smartmat

As illustrated in FIGS. 1 and 4, Smartmat 10 detects presence of a subject by pressure of their foot fall on one or more sensors. These sensors may be organized in segments, each under the supervision of a micro-controller. A Smartmat 10 may be composed of one or more of these segments connected in a network to a Data Collector 20 that in turn may be connected to a computer 40 capable of performing the analysis. The analysis can be either immediate or deferred in which case the collector stores the data until requested for analysis.

Smartmat 10 sizes may be limited by total power consumption in instantiations where available energy is limited. They may also be limited by available bandwidth of the data bus within Smartmat, such as the exemplary $I^2C$ network shown in FIG. 5. For mats with more than about 50 segments, a multi-level organization may often be required. In FIG. 5, large mat segments 10A, 10B, 10C, etc. are connected to a Data Concentrator PC through the exemplary $I^2C$ network and then by a higher speed bus to the data collector. This is typically accomplished with an 8 bit parallel bus with at least 1 megabyte/second transfer rate, but other bus configurations and transfer rates are possible.

It is possible to integrate the signals from multiple mats using several different methods, such as synchronizing with a timing pulse as shown in FIG. 6. Using this exemplary method, the collected data may be built into a single file by the data analysis program. The timing pulse may be distributed by a wire or wirelessly and each of the data collectors is capable of either generating the pulse or accepting a pulse from another.

Segment Organization

As defined for this specific exemplary instantiation of Smartmat, the segment is the Smartmat's basic building block. It may consist of a circuit backing. Examples of this include a thin, flexible printed circuit fiberglass with copper traces, and polyester/Kapton material with silk screened silver traces, although other approaches are possible. As shown in FIG. 7, each segment may have a number of sensors arranged in, for example, a rectangular grid connected to a micro-controller that can read the sensor state. The micro-controller may be connected to other segments in the X and Y direction using and internal bus such as the Phillip's $I^2C$ network or other medium-speed, low-power connection strategy. The network wires also carry power between segments.

In some instantiations, segment size may be limited by the number of sensors the micro-controller can read. The number may also be limited by sensor size. For example, certain types of analog bend sensors may take more space then certain types of conductive rubber sensors. To increase sensor density, segments can also be built with multiple processors thus limiting mechanical connections to adjacent segments and multiple layers to accommodate higher sensor. In an example instantiation, each segment processor reads the sensor state, compresses and stores the data, and then waits for a request from the Data Collector unit for this information.

Sensing Modalities

Many types of sensing modalities are possible with Smartmat. Two exemplary modalities—analog and digital—are selected for discussion below.

Exemplary Digital Sensing Approaches

Among the more simple sensing modalities is an electrical switch. This can be anything from a membrane switch to rubber that changes resistance with pressure. These switches may be placed several geometries such as a rectangular grid. An exemplary segment circuit is shown in FIG. 8. In this example, to read the state of a particular switch, say $S_{21}$, the micro-controller turns on the digital output $D_1$ and turns all the others off. It then reads the value of $D_{in2}$. If the switch is on, a value of 1 is read, if off a value of 0 is read. The entire state of, for example, a 12×12 grid of switches can thus be stored in 18 bytes of data. Using this exemplary approach, it is sometimes possible for ghost sensors to appear when there are multiple switches actuated. In FIG. 9, the exemplary system is attempting to read the state of switch in upper right hand corner, but the three surrounding switches are closed and conducting. Thus, the target switch appears to be on because the alternative path, shown by the dashed line, allows current to flow to the sensing line. This causes sensed footprints to be rectangular in shape. It is likely that sensor ghosting will be most problematic when two or more subjects are walking in close proximity and the extra cells cause the two prints to appear as one. This special case may be rectified using several different methods, such as by using an algorithm to match shapes against a shape grammar and by time changes in the footprint outline. This approach may provide the lowest cost solution because of the few required components and the low cost of these components in the current market. In addition, great sensor densities are possible with this approach as the sensors can be made quite small and the micro-controller can be relatively primitive.

An analysis of a specific design among the many possible examined a Smartmat comprised of 12×12 sensors sampled at a 60 hertz rate. In this example, the standard 400 kilobits per second $I^2C$ network rate was used, thus limiting a single Smartmat size to 46 segments. A simple compression scheme sends the indices of only those sensors that are activated by a footprint. Other compression schemes may also be used provided that a sufficient approximation of the actual data can be reconstructed by the data analysis algorithms. Experiments using the specific design have shown that the average footprint size, with ghosting, when standing still, is about 55 sensors with a sensor density is 144 per square foot. Thus the specific Smartmat design examined would be capable of sensing a maximum of 7 people standing without moving before saturating. If the subjects are moving the number of active sensors at any given sample averages less than half of the total size and many more subjects can be sensed at one time.

In addition to software approaches, there are many hardware solutions to the ghosting problem. In FIG. 10, a particular exemplary approach is shown selected from the many possible approaches. It uses extra resistors to form a voltage divider network. Analog to digital converters determine the state of each switch. This specific, exemplary approach requires (rows+1)*columns fixed value resistors making construction more expensive. The extra resistors ($R_{0,0}$-$R_{n,n}$) provide a way to isolate the digital lines ($D_0$-$D_n$) from each other. In this scheme, one digital line is energized at a time while all other lines are grounded. The energized digital signal now has only one path to any of the desired input lines ($A/D_0$-$A/D_n$). Although the signal can only travel on its desired path, the signal level is still subject to change with the number of switches closed per column. This is not a problem since the input lines are read as an analog signal. The switch is then considered to be ON when its analog value is greater than 0 volts. The software considerations for this exemplary approach are similar as for the network without the resistors. Some network throughput may be increased because fewer sensors will appear on for any given footprint.

Exemplary Analog Sensing Approaches

One type of analog sensor would use pressure sensitive resistors to detect both the presence of a foot and to infer its contact pressure. This style may require that the micro-controller provide 8 bit analog to digital conversion that can perform on the order of 10,000 conversions per second. An exemplary circuit for a segment is shown in FIG. 11. To read the value of a particular sensor, the micro-controller may place a high signal on the appropriate row and read the voltage value on the corresponding column. In several embodiments, the number of sensors is limited by the number of driver and A/D converter lines available on the micro-controller. One exemplary approach for limiting ghosting entails that the sensor resistors $R_{ij}$ and their corresponding voltage divider resistors $R_i$ are chosen so that the ratio is approximately X to Y. This particular approach lowers the ghosting contribution to less than XXX % of the signal.

In one exemplary Smartmat instantiation, sending all 144 eight bit values in a segment at 60 hertz imposes an undue burden on the communication network. Assuming a limit of 400 kilobits per second, this would limit the mat to about 5 square feet or restrict the number of sensors for each segment. Bandwidth issues may be partially addressed by data compression. For example, simple data compression such as run-length encoding each sensor's value over time would save significant bandwidth. Other compression schemes might include:

1. Limit the number of binary digits for each sensor. Many of the low order bits generated by analog to digital converters are electrical noise or the result of ghosting. By not sending these bits, bandwidth requirements are reduced.
2. Send only changes. Keep a running average of each sensor's value and send only sensor readings with value changes significantly over a single sample or some other threshold. Send the index and truncated value.

Any selected compression algorithm would benefit from a 10 to 1 compression ratio to larger mat sizes and data rates.

Exemplary Smartmat Components

This section presents one example of a Smartmat configuration and example components that could be used in this configuration. There are many other configurations and component selections possible.

Smartmat hardware may be composed of one or more segments with embedded sensors connected to a data converter and concentrator. These segments will typically by 1' by 1' square, although many different shapes are possible. Segments may be connected to form a carpet and linked with, for example, a 400 kilobit/second $I^2C$ network to a data accumulator or network interface. In an "off-line" mode, the collected data may be stored on a low-power flash memory card for analysis at a later time. In "real-time" mode, data may be transferred over an Ethernet or other means to a remote processor for analysis or viewing.

Conductive Rubber Sensor

A sensor can be built from conductive rubber. As pressure squeezes the rubber, its resistance changes appreciably. As shown in FIG. 12, this can be detected by placing small plated fingers or other geometry under a small piece of the rubber and connecting these to a micro-controller for sensing and storage. An alternative scheme uses membrane switches for the same effect. The rubber for these sensors sits on top of interlaced plated fingers designed to maximize the likelihood that pressure anywhere on the piece will let current flow between the two circuits, although there are other geometries that also achieve this effect. FIG. 12 shows one exemplary typical configuration. In one possible embodiment, the conductive rubber is cut into 2 mm strips and glued to the circuit substrate between sensor areas.

Bend Sensors

In this example, each mat segment contains man bend sensors capable of detecting deformation caused by surface pressure. An example single-element sensor is shown in FIG. 13. One attractive feature of bend sensors is that a network of almost any two-dimensional shape may be developed.

As illustrated in FIG. 14, the sensor changes its resistance when bent—more bend makes a greater resistance. The sensor's total resistance is proportional to the integral of the positive differential of bend angles over the sensor's length. This change of resistance is sampled by the concentrator microprocessor with an analog to digital converter and converted to a number. Amplification of the signal is often necessary to improve resolution and reduce noise.

Each segment may contain a number of sensors in a horizontal (or vertical) array connected in series across a single line. These may be sampled through printed wires to an edge connector by applying a low voltage and measuring its drop through the resistance.

Data Accumulator

An exemplary data accumulator has the organization shown in FIG. 15. The CPU is typically an 8-bit micro-controller that supports network communications with the Smartmat hardware and appropriate external communications such as USB, Ethernet, or RS232 serial. It may support a time-of-day clock for synchronization, some local display and communications, and communication with local data storage.

The data accumulator performs many functions, such as those listed below by way of example:

1. Download new code to the Smartmat processors and itself. Smartmat processors may use flash data storage for executing programs. Once the mat is constructed it is frequently no longer possible to connect directly to each processor and change its program. A program loader sits in each segment and waits for commands over the $I^2C$ or similar network. If a command to load a new program is received, the existing program is erased and the bytes of the new program are stored. In this fashion, all Smartmat segments can be reprogrammed at once. The Data Collector is responsible for passing this new program between the host computer and the Smartmat segments. The Data Collector itself has a loader capable of accepting a program from its host via its host interface.

2. Maintain a real time clock. Data taken from Smartmat segments may be time-stamped with the date and time. This time-of-day clock may have a battery backup that would be continually recharged when the collector is in operation. The time of day would remain active even if the collector is powered off for some time period. Use of the time-of-day stamp allows the analysis code to correlate multiple Smartmats and video capture when necessary.
3. Communicate with the Smartmat segments. The Data Collector CPU may be able to talk to the Smartmat communications network, typically the Phillips $I^2C$ network running at 400 kilobits per second. In the off-line mode, the segments are sampled and their data stored in local data storage, typically a large, low-power, NAND-flash memory. Other storage media are possible and may include demountable media such as Secure Digital (SD) or Smartmedia. The Data Collector may also discover how many Smartmat segments are on-line and reconcile this with the stored geometry description.
4. Store the Smartmat geometry. The Data Collector may be responsible for storing the Smartmat geometry. This description has a block of storage for each segment with the following information:
   The segment's number.
   The X and Y coordinate of the segment.
   The segment orientation in 90 degree increments.
   The geometry description also includes the number of segments, the sample rate in milliseconds, the number of sensors in each segment, their type (analog or digital), and their spacing. This information is stored with each file or communicated to the host for real-time display. The geometry description is normally loaded as a part of the Data Collector program
5. Local Storage. At a minimum the file system may be able to erase the local storage and list the files and their sizes. It should also be able to detect how much storage is available.
6. Perform real-time communication with a personal computer for visualization. Upon command from the host processor, the Data Collector asks each segment for its data and passes this (in a standard format) to the host for display of the sensors and optional storage.
7. Store Smartmat data in local bulk storage and maintaining a file system. The Data Collector may run off-line, that is, not connected to a personal computer host. The Data Collector may include some sort of file system so that each time the Smartmat is turned on a new file is created until the storage is full. 128 megabytes can store about 3.6 bytes every $1/60^{th}$ of a second for an entire week. With suitable compression techniques, that is, not storing any data when the Smartmat is quiescent, an entire week's worth of data may be stored for some Smartmat embodiments.
8. Upload data collected off-line to a personal computer. When communicating with the host personal computer, the Data Collector may be able to communicate the contents of its local storage. The personal computer user can specify which files to upload from the collector. The data collector may upload this data as fast as possible and with reasonable data integrity checking
9. Synchronize with other Smartmats or providing a clock pulse. The Data Collector may be able to synchronize its off-line data collection with prompts from a master Data Collector. Likewise, as a master, it may be able to send this synchronization signals to other collectors. The control of this activity may be provided by the host personal computer or some other approach.
10. Provide a video camera trigger for experimental or security purposes. The Data Collector may detect the presence of a footfall and provide a signal to a video device to capture the subject's presence. This would be particularly useful for algorithm tuning and security systems.
11. Local Display and Control. The Data Collector may have sufficient communications capabilities so that setup errors can be communicated to the user when attempting to run off-line. Examples include a small 8×2 LCD, segment display, or flashing LED's. One or more pushbuttons can help to stop and start the off-line data collection.

Exemplary Non-Limiting Data Analysis

One goal of the exemplary non-limiting Smartmat implementation is to count the number of individuals crossing its sensor space. One possible algorithm flow is shown in FIG. 16. The system is organized as a pipeline with data feeding into the first section and a summary appearing at the end. The data file is taken from Smartmat either off-line or in real-time. Data are expanded into a sensor image, footprints and other signatures are isolated and then classified. Footprints from individuals are connected into paths, the gait and weight is computed (optional) and a summary appears.

It is expected that a micro-processor with a reasonable amount of program and data space could perform these analyses in real-time making for a complete stand-alone Smartmat system. In the following sections we assume that either Smartmat is connected to a powerful personal computer or a stand-alone system dedicated to the task. The algorithms are tuned with parameters that may be discovered by experiment or through modeling. In some instantiations, some parameters may be specific to an individual Smartmat.

Exemplary Input Data

As described earlier, input data includes the Smartmat geometry, sample rate, time-of-day, frame-number and the sensor information. Data are either collected off-line or provided to the algorithm in real-time. One possible embodiment of the algorithm assumes the pipeline organization of FIG. 16 with system buffering between tasks. If the exemplary Smartmat has no active sensors, the pipeline empties whereas a large number of active sensors or subjects standing still may fill the pipes and cause a real-time reporting lag.

The following description assumes that input data is stored in frames, the sensor values for a single instant in time, as a matter of convenience. Many other approaches for managing input data are also possible. Each frame has a unique identification number and the frame rate is frequently known (typically 60 hertz but this is not required). The discussion follows the flow of FIG. 16.

Exemplary Expand Function

The Smartmat input data may be converted to a form suitable for image processing. The data expansion phase takes the available frames and expands them into a movie as may occur as follows:

1. The geometry is interpreted and data structures built to accommodate incoming data. A frame is created and passed through the pipleline with its storage reused when processing is complete. If a movie is being made for visualization purposes, these frames may be stored on disk.
2. A compressed frame is expanded into an X-Y image with each cell representing a sensor state. For digital sensors the values are usually 0 and 1, but, analog sensors may have 4 or more bits stored for each.
3. There may be missing frames—times when the Smartmat has no active sensors. In this case the pipeline is filled with empty images. However, if an extended quiescent period is detected (this is a parameter and is usually 2 seconds or more), the image stream may be terminated—a new one starts at the next time an active sensor is found.

This task can be visualized as shown in FIG. 17. Here the Real World represents the frames where the Smartmat had active sensing. The Compressed Data shows those frames (2, 3, 4, 5, 7, 8, 10, 25, 26, 27, 29, and 30) that had active sensors (perhaps two subjects some seconds apart). The expansion phase builds these into two data sets, and fills in blank spots where the inactive period was too short. When a data set is terminated (it can have empty frames at its end), the pipeline is emptied until another data set is started by the presence of a new subject activating sensors.

Exemplary Isolating of Entities

This step builds footprint representations for the time ordered images delivered by the expansion phase. When walking, not all the foot is contacting the mat surface at one time so the algorithm is best described as a 3-dimensional polygon fill. FIG. 18 shows 4 images of a foot over time. First the heel makes contact, then the front part of the sole, and finally the toe release. The heel contact in frame 1 is separated from the sole contact in frame 2 by one sensor—most shoes have a blank spot for the foot arch. The fill algorithm allows multiple blanks (a parameter usually set to 2) between components. Otherwise, the algorithm is a standard recursive flood fill in all 8 orientations. Other more efficient algorithms are possible if the skip distances can be met. The fill is used to isolate a single part of the print that is then collected over time.

The exemplary algorithm collects areas across time and builds the outline of single footprint with its start and end time, center of gravity, moving center of gravity and total area. The algorithm keeps a list of active footprints. Each footprint is a list of filled areas (foot-parts in the text that follows) which in turn are lists of active cell indices. A pseudo-code description follows:

1. In the current frame, locate an active sensor that has not yet been examined. If none are left, then go to step 10.
2. Perform the polygon flood fill (or other algorithm) using this sensor cell index as a basis. Collect these cell indices into a list.
3. If the list is shorter than some fixed length (usually 2 but this is a parameter), then reject this potential part of a print and go back to Step 1.
4. Compute the center of gravity (CG) of the set of cells and the total area (normalized for sensor density). If analog sensors are being used, the CG may be computed by weighting each cell value.
5. Examine the list of stored footprints and compute the distance between this foot-part CG and the CG of the latest foot-part of each print. Select the footprint with the least distance in both time and space; however, if the footprint already has a foot-part at this time go to Step 6 otherwise go to Step 8.
6. If the Euclidean distance between CG's is smaller for the new part, replace this part and retry step 5 with the replaced part removing this footprint from consideration.
7. If the Euclidean distance between CG's is greater for the new part, retry step 5 with other footprints. The algorithm is assured of finishing because each loop iteration removes another print from consideration until a component fits with one or starts a new footprint.
8. If the distance exceeds some minimum value (a parameter), create a new footprint with this foot-part as its first component and go back to Step 1.
9. Add this new foot-part to the list for the nearest footprint. Go back to Step 1.
10. Age all the footprints. If any exceed a time threshold (a parameter) without new foot-parts, these are closed and passed to the next pipeline element. Otherwise get the next frame (if any) and go back to Step 1. If there are no more frames or there is a frame break, then close all footprints and pass them to the next pipeline element.

In addition to the footprint area and parts, we also compute:

11. The center of gravity of all cells participating in the footprint (with cells weighted for analog sensors).
12. The CG of each foot-part in time order.
13. The total footprint area.
14. The average area over time.

Exemplary Classifying of Footprints

The classifier's job is twofold: reject (and possibly classify) selections that do not resemble human footprints, and, classify others by their signatures. Example classifications include:

1. Noise—Analog systems are subject to both electrical and mechanical noise, usually single sensors firing at random times. Some of these are removed during the isolation phase, others are removed by size and duration.
2. Animals—These can be removed by their footprint size and duration. Some are removed as noise and others may not have time characteristics similar to humans (horses for example).
3. Wheels—These have long thin tracks where the ratio of the average number on to the total print size is very small.
4. Other inanimate objects—Things that don't move such as boxes or large areas that don't change much with time should be rejected.

One possible approach is to establish a footprint grammar that classifies each footprint passed from the isolation stage. Some of these are rejected or their information is passed to the summary stage bypassing the path, gait and weight computations. The grammar primitives are those values computed by the isolation stage and more as follows:

1. Width to height ratio (is square? is rectangular?)
2. Center of gravity movement. We use linear least squares for the X and Y components of a footprints CG over time. This allows us to predict the subject's direction of movement or lack thereof.

Each footprint then passes through the grammar for rejection and classification. The initial grammar set for classifying human footprints is the following.

If the width to height ratio is >4 or less than 0.25, then classify as a wheel.

If the total size is less than 10 square inches, then classify as noise.

If the total size is less than 20 square inches, then classify as animal footprint If the total size is greater than 100 square inches, and the delta CG movement after 1 second is less than 0.25 meters then classify as non-moving inanimate object.

Anything else is a footprint and passed to the next element of the pipe line.

Additional rules may be used for classifications of other entities or higher level classifications of shoe type if the sensor density permits it.

Paths

Once the footprints have been identified, they may be chained together to make a path. For example, FIG. 19 has two subjects with multiple footprints on the Smartmat. The algorithm may string these together to identify them as belonging to a single subject.

The exemplary algorithm proceeds as follows:

1. Examine a contact event. Check all current paths and determine which path the event is most likely to belong to. The measures are:
   a. Distance. Estimate where the next contact event should be from the angle and speed of the last event on the chain. The location nearest to the event gets the highest score.
   b. Weight. Check the weight against that estimated. Weights nearest to the estimate get a higher score.
   c. Outline. Compare the contact events in time and space (suitably rotated). Events that have a high matching correlation get a higher score.

The path with the highest score gets the contact event added to it and its statistics updated. If no score is above a fixed value, a new path is generated.

2. Examine all paths. If a path has been inactive for a set interval and the last contact event indicates movement, the path is inactive and removed from the active list.
3. Repeat until all contact events are processed.

The result is a list of pedestrian paths formed from ordered contact events.

Exemplary Weight and Gait Analysis

Contact pressure is detected in terms of force rather than weight. Whilst walking and running, this force is many times the subject's weight. To determine each subject's approximate weight, each path may be examined.

1. Compute the area by area fill (remember the sensors only give the force outline).
2. Sum forces over the filled area.
3. Repeat for all time steps of the event.
4. Sum all the time steps and divide by the total time. This should give the approximate subject mass. Average over all contact events in the path.

To characterize the gait, compute the time between steps and the average contact event duration. A fuzzy logic approximation with weight, step length and contact duration should allow us to characterize walking, running, skipping, standing still or shuffling.

Exemplary Output

The program will then summarize the paths for output to a data file or directly to the screen for viewing by a user.

1. Weight. A histogram of pedestrian weights.
2. Gait. How many are walking, standing still, running, skipping, hopping, etc.
3. Speed.
4. Average path length.
5. Direction.
6. Other detected types (wheeled, animal, etc.)

Exemplary Potential Commercial Applications

Smartmat is capable of monitoring pedestrian traffic patterns over large areas at low cost. Smartmat nay be portable, easy to set up and use, vandal-resistant and theft resistant. It may resemble a common industrial carpet in appearance and thus may be used to monitor traffic inconspicuously.

Potential markets include:

Physical activity researchers and government intervention result monitors

Airport, train station, hospital, amusement park and stadium managers for traffic flow monitoring Large building security managers for traffic flow monitoring and low-cost camera tracking Park supervisors for trail usage tracking Grocery stores and other retail outlets to track traffic patterns (e.g. "Where can I place my high-profit items such that it generates the most traffic at sufficiently slow speeds for shopping?")

Emergency evacuation of large buildings (e.g. Able to monitor exact count of all tenants within building at any time, thus yielding accurate count of those remaining as evacuation proceeds.)

Monitoring movement of naval personnel on-ship to evaluate crew efficiency and assist in emergency procedures Identifying specific humans Other While the technology herein has been described in connection with exemplary illustrative non-limiting embodiments, the invention is not to be limited by the disclosure. The invention is intended to be defined by the claims and to cover all corresponding and equivalent arrangements whether or not specifically disclosed herein.

We claim:

1. A sensor system comprising:

a sensory structure that can be walked on, said structure having sensors therein that detect objects in contact with said structure; and at least one classification routine, operable to aggregate successive sensory detection by portions of said structure over time to approximate the footprint shape of an object that is in motion across said structure, such that not all portions of said object that eventually contact said structure to comprise said footprint are in contact with said structure simultaneously;

determine a relationship between a plurality of approximated footprints generated by the object and, based at least in part on the determined relationship, to associate the plurality of footprints generated by the object with each other to form an object path; and classify said object into one of a plurality of predefined categories, based at least in part on a detected gait of the object, the gait determined at least in part based on the footprints comprising the object path.

2. The sensor system of claim 1, wherein said at least one of classification routine is further operable to determine, in time order, the center of gravity of each object portion contacting said structure to comprise said footprint.

3. The sensor system of claim 1, wherein said at least one classification routine is further operable to distinguish between footprint shapes that do not resemble human footprints and footprint shapes resembling human footprints, based on characteristics associated with said footprint shapes.

4. The sensor system of claim 3, wherein said characteristics include width to height ration of a footprint.

5. The sensor system of claim 3, wherein said characteristics include movement of a center of gravity of a footprint.

6. The sensor system of claim 3, wherein said at least one classification routine is further operable to distinguish between shapes resembling human footprints based on additional characteristics.

7. The sensor system of claim 1, wherein said at least one classification routine is further is operable to estimate, for one or more of the object paths, a position on said structure where a next footprint in each object path should lie, and wherein said at least one classification routine is operable to compare a detected footprint's location to the estimated position of the next footprint for one or more of the object paths, wherein said at least one classification routine is further operable to determine that the detected footprint shape is the next footprint for a particular object path, based at least in part on said comparison.

8. The sensor system of claim 1, wherein said at least one classification routine is further operable to estimate a weight of a next footprint for one or more of the object paths, and wherein said at least one classification routine is further operable to compare a detected footprint's weight to the estimated weight of the next footprint for one or more of the object paths, wherein said at least one classification routine is further operable to determine that the detected footprint is the next footprint for a particular object path, based at least in part on said comparison.

9. The sensor system of claim 1, wherein said at least one classification routine is further operable to estimate a shape of a next footprint for one or more of the object paths present, and wherein said at least one classification routine is further operable to compare a detected footprint's shape to the estimated shape of the next footprint for one or more of the object paths, wherein said at least one classification routine is further operable to determine that the detected footprint is the next footprint for a particular object path, based at least in part on said comparison.

10. The sensor system of claim 1, wherein said at least one classification routine is further operable to identify a person based at least in part on the detected gait.

11. A method for sensing a footprint associated with an object at least partially in contact with a sensory structure that can be walked on, said structure having sensors therein that detect objects in contact with said structure, the method comprising:

detecting contact of at least a first portion of said object with said structure;

storing said contact as a new footpart;

associating a timing with said new footpart;

associating at least one location identifier with said new footpart;

if any footparts are not presently stored, associating a new footprint with said new footpart;

if any footparts are presently stored, comparing the timing and location identifier of said new footpart with the timing and location identifiers of at least one stored footpart;

if any footparts are presently stored, selecting a stored footpart corresponding to said new footpart based at least in part on said comparing;

if the distance between said new footpart and said selected stored footpart does not exceed a predetermined threshold, associating said new footpart with a footprint associated with said selected stored footpart; and if the distance between said new footpart and said selected stored footpart exceeds a predetermined distance, associating a new footprint with said new footpart.

12. The method of claim 11, wherein at least one of the at least one location identifiers is based at least in part on the center of gravity of said footpart.

13. A method for sensing a footprint associated with an object at least partially in contact with a sensory structure that can be walked on, said structure having sensors therein that detect objects in contact with said structure, the method comprising:

detecting a plurality of footprints said object;

determining a center of gravity movement based at least in part on said detected footprints; and assigning a first classification to said object based at least in part on said center of gravity movement.

14. The method of claim 13, further including:

determining a width to length ratio of one or more detected footprints;

assigning a second classification to said object based at least in part on said width to length ratio.

15. A method for sensing a gait associated with an object at least partially in contact with a sensory structure that can be walked on, said structure having sensors therein that detect objects in contact with said structure, the method comprising:

detecting a plurality of footprints of said object;

determining a weight associated with said object;

determining the approximate distance between each successive footprint in said plurality of footprints;

computing the average duration of contact for each of the plurality of footprints;

determining gait based at least in part on weight, step length and contact duration.

16. A method for sensing an object path associated with an object at least partially in contact with a sensory structure that can be walked on, said structure having sensors therein that detect objects in contact with said structure, the method comprising:

detecting a new object footprint;

determining if any object paths are currently present in at least one memory area;

if no object paths are currently present, associating a new object path to said detected new object footprint and storing said new object path in said at least one memory area;

if at least one object path is currently present, estimating the location of a next footprint for at least one of the at least one object paths currently present;

comparing the location of the new footprint with the at least one estimated locations;

if at least one object path is currently present, estimating a weight associated with a next footprint for at least one of the at least one object paths currently present;

comparing the weight of the new footprint with the at least one estimated weight;

if at least one object path is currently present, estimating an shape associated with a next footprint for at least one of the at least one object paths currently present;

comparing the shape of the new footprint with the at least one estimated shape; and if at least one object path is currently present, determining an object path with which to associate said new footprint, based at least in part on said comparing the location, comparing the weight, and comparing the shape.

* * * * *